US006226901B1

(12) United States Patent
Rosen

(10) Patent No.: US 6,226,901 B1
(45) Date of Patent: May 8, 2001

(54) ADJUSTABLE FOOT ORTHOTIC

(76) Inventor: Henri E. Rosen, 229 Coolidge Ave., Watertown, MA (US) 02472

( * ) Notice: Subject to any disclaimer, the term of this patent is extended or adjusted under 35 U.S.C. 154(b) by 0 days.

(21) Appl. No.: 09/333,646

(22) Filed: Jun. 15, 1999

(51) Int. Cl.[7] ..... A61F 5/14
(52) U.S. Cl. ..... 36/159; 36/97
(58) Field of Search ..... 36/155, 156, 157, 36/158, 159, 43, 44, 97

(56) References Cited

U.S. PATENT DOCUMENTS 5,036,604 * 8/1991 Rosen ..... 36/97
5,060,402 * 10/1991 Rosen ..... 36/97
5,203,096 * 4/1993 Rosen ..... 36/159
5,241,762 * 9/1993 Rosen ..... 36/97
5,325,614 * 7/1994 Rosen ..... 36/97

* cited by examiner

*Primary Examiner*—Paul T. Sewell
*Assistant Examiner*—Jila M. Mohandesi
(74) *Attorney, Agent, or Firm*—Bruce E. Jacobs

(57) ABSTRACT

A shoe bottom assembly is described in which the transverse angle of the foot-supporting surface is manually adjustable.

16 Claims, 6 Drawing Sheets

ADJUSTABLE FOOT ORTHOTIC

BACKGROUND OF THE INVENTION

There continues to be a recognized need for a wearer-adjustable orthopedic foot support system for use in footwear, to compensate and correct for the excessive downward rotation of the foot when weightbearing, which is termed "pronation" when it occurs on the inside or "medial" side of the foot, and "supination" when occurring on the outer "lateral" side thereof, either condition usually causing unnecessary discomfort and fatigue, and often leading to chronic trauma of the foot and related anatomy if left uncorrected over time.

Heretofore, the usual corrective approach has been in the use of insertable shoe orthotic assemblies preferably custom fitted by podiatrists, (DPM's) or similar specialists, for use in the patient's preferred shoes wherever possible. While this approach has had undeniable success, it still presents limitations, which this invention will address, including high cost of initial inserts and relatively frequent replacements thereof as well as to their relative inadaptability to typical dynamic change in correction usually experienced by the user. There is also an increasing call for orthotic systems adjustable by the knowledgeable consumer, particularly in athletic applications.

This invention essentially comprises significant improvements on the cant-adjusting means disclosed in U.S. Pat. No. 5,036,604, which improvements have proven necessary and critical for general consumer acceptance of the concept. These improvements relate to increased and improved comfort as well as a wider adjustment range possible with the predominantly transverse adjusting means of the present invention, features necessary but unattainable with any combination of the predominantly longitudinal or simple rotary adjustment motion disclosed in U.S. Pat. No. 5,036,604.

Accordingly, it is the object of the present invention to provide improvements in adjustable orthotic foot-supporting systems for use in footwear and preferably integral therewith.

For a fuller understanding of the nature and objects of the present invention, reference should be made to the following detailed description taken in connection with the accompanying drawings.

SUMMARY OF THE INVENTION

The present invention is directed to an adjustable foot support system for use in a shoe, having a toe portion, a heel portion, and a mid-portion therebetween, comprising (i) a footbed assembly which has a flat bottom surface and an upper surface which has raised peripheral edges at the mid-portion that slope gradually downward from each edge towards the longitudinal center of the footbed assembly so as to form a concave contoured surface facing upward at about the mid-portion; (ii) a shim member having a flat upper surface and a lower surface which has a transversely convex contour at about the mid-portion facing downward, thereby matching and fitting together with the footbed assembly located therebelow, and having the shim mid-portion being narrower than the corresponding footbed assembly mid-portion, and (iii) a means for moving the shim member transversely (from side to side), thereby adjusting the angle of the flat upper surface of the shim member relative to the flat lower surface of the footbed assembly.

This invention is also directed to a shoe comprising the adjustable support system inserted in the shoe.

DETAILED DESCRIPTION OF THE INVENTION

Figure 1:
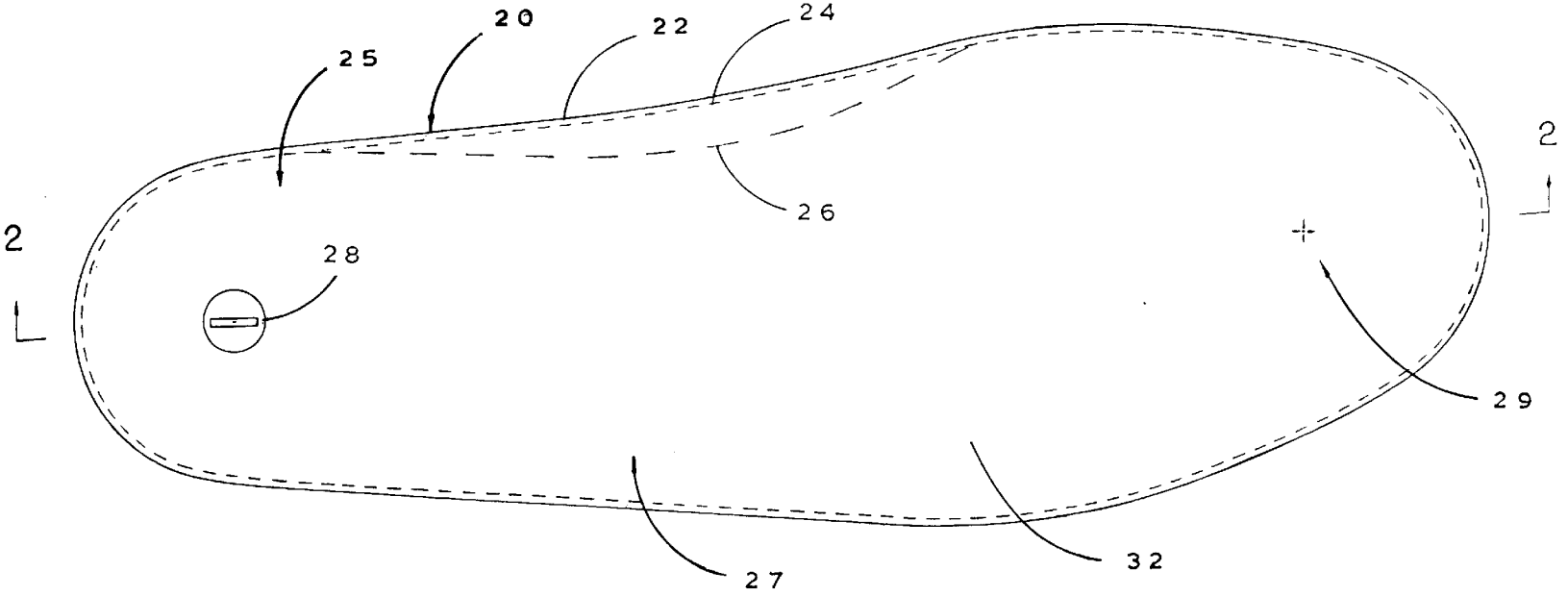
FIG. 1 is a plan view of an adjustable support system embodying principles of the present invention.

Improved means for the manual adjustment of the transverse angular tilt or "cant" of a shoe bottom assembly will be described with reference to a removably insertable adjustable support system for use in shoes designed therefor. It should be understood that this approach is taken to simplify understanding of these improvements, and that similar non-removable assemblies within a shoe or its bottom elements are to be considered equivalents and generally preferable thereto for most applications.

Referring to the drawings, FIGS. 1 through 17 show embodiments of the adjustable support system of the present invention.

As shown the adjustable support system generally comprises a footbed assembly 20, shim 30 and a means for moving the shim 30 transversely relative to the footbed assembly 20, comprising cam 34 and strut 36, to adjust the cant of the shim. As shown in FIG. 1, footbed assembly 20, having a heel portion 25, mid-portion 27 and toe portion 29, comprises a base member 22 to which a covering socklining 32 is secured by a suitable means such as edge-stitching 24 to the top surface of base member 22, a manually adjustable slotted-head camshaft 28 attached to the base member 22, all by bottom member 26. Alternatively, base member 22 and bottom member 26 may be a single integral unit.

Figure 2:
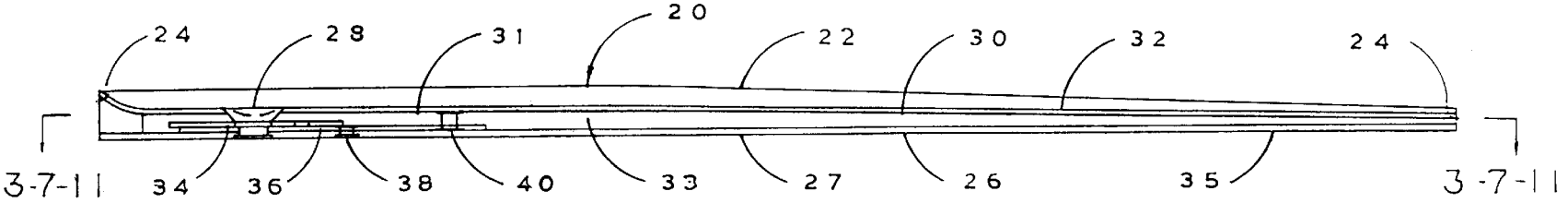
FIG. 2 is a side-elevational cross-section of the adjustable support system of FIG. 1 taken on line 2—2 thereof.
Figure 4A:
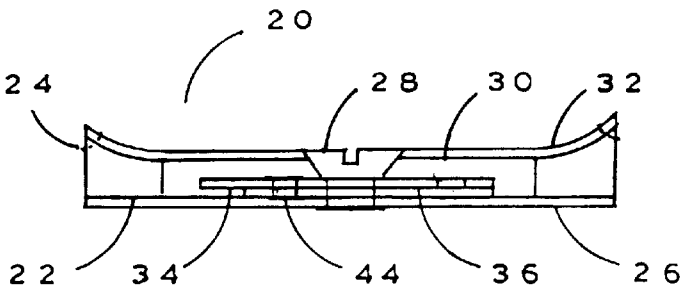
FIG. 4A is an exploded view of a portion of the adjustable support system of FIG.4.
Figure 2A:
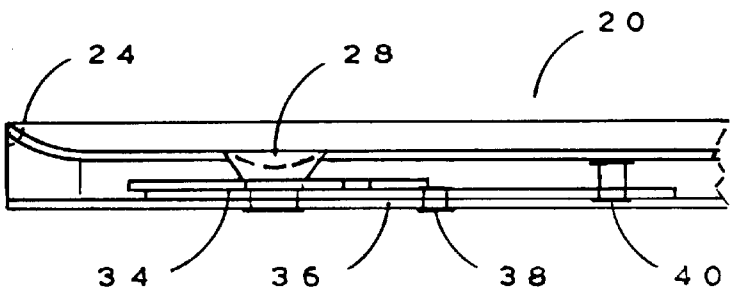
FIG. 2A is an exploded view of a portion of the adjustable support system of FIG.2.

FIGS. 2 and 2A shows the above elements plus a cantably adjustable shim 30. The shim 30 has a heel portion 31, a mid-portion 33, and a toe portion 35, corresponding to portions 25, 27, and 29 of the footbed assembly 20 (see FIG. 1), respectively. In addition, an adjustable circular cam 34 is shown as being movably connected to an adjustable strut 36, with strut 36 attached to the bottom member 26 by means of rivet 38 and to the shim 30 by means of rivet 40. Cam 34 is fixedly attached to camshaft 28 by which it can be manually rotated to adjust the effective transverse cant of the flat top surface of shim 30 and sock 32 which covers shim 30 relative to the flat bottom surface of footbed assembly 20, as will be further described with reference to the following FIGS. 3 through 15, inclusive.

Figure 3:
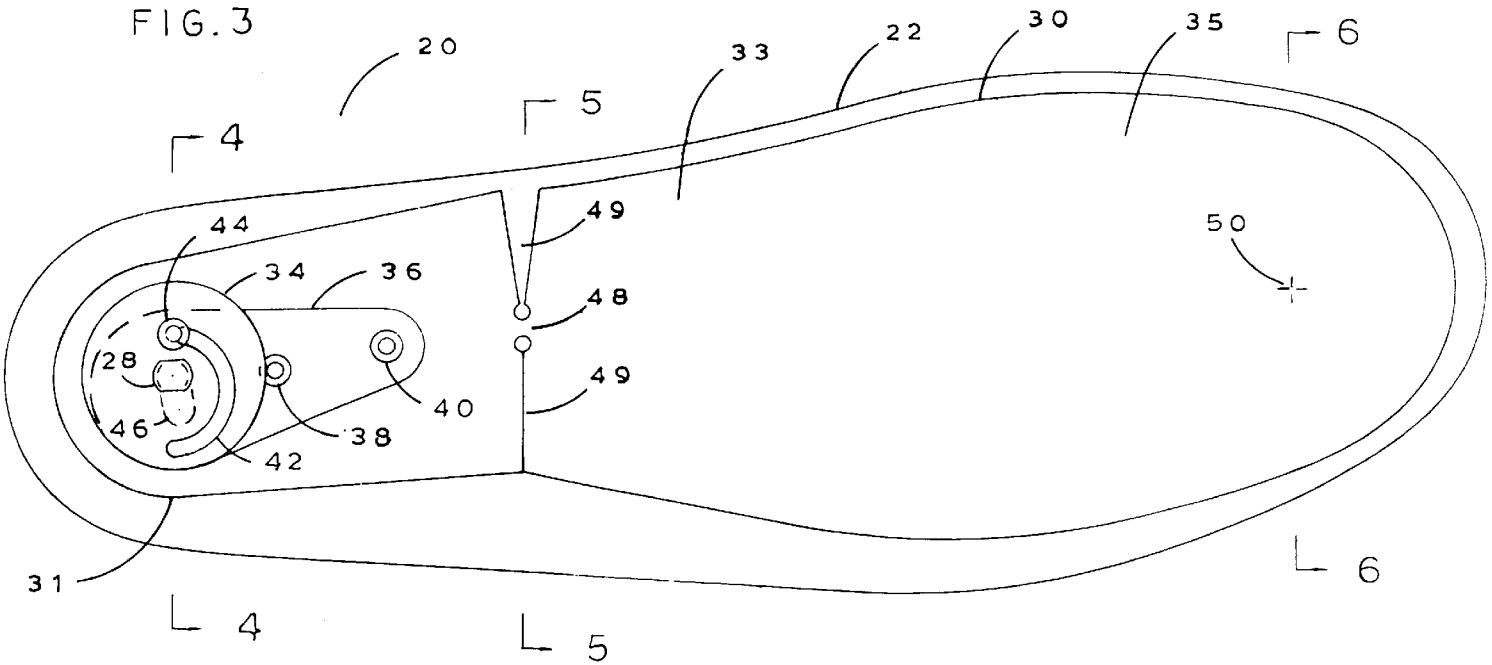
FIG. 3 is a plan view of the adjustable support system of FIG. 2 taken on line 3—3 thereof.

FIG. 3 shows a plan view of footbed assembly 20 wherein shim 30 has been transversely adjusted with a maximum of such adjustment occurring at shim hinge portion 48 (line 5—5) as hinged shim 30 articulates at said hinge 48, with shim heel portion 31 rotating around camshaft 28 at the heel end of footbed assembly 20, and rotating generally around forepart axis 50 with such adjustment. As shown, the shim hinge is formed by two slots 49 in the shim 30. This so-adjusted orientation of shim 30 towards one side of the adjustable support system results from the manual rotational adjustment of camshaft 28 and cam 34 fixedly attached thereto, with concurrent adjustment thereby of the longitudinal angle of strut 36 as it is rotated around its rivet 38 connection to bottom member 26 thereunder, said change in strut 36 angle resulting from the change in radial distance of rivet 44 from the rotational axis of camshaft 28 and cam 34 as they together adjustably move said rivet 44 and the rearward portion of strut 36 to which rivet 44 is fixedly attached, thus adjusting strut 36 angularly thereby as rivet 44 is moved radially by the offset arcuate cam-slot 42 by which rivet 44 is contained and so radially adjusted. The construction which permits this operation provides for rivet 38 to be attached through strut 36, shim 30 and footbed bottom member 26 to allow rotary adjustment of strut 36 and shim 30 therewith, as controlled by rotary adjustment of cam 34, which is attached to all parts by camshaft 28, and which cam 34 is also attached to strut 36 only by rivet 44, radially adjusted by means of arcuate slot 42 in cam 34. While FIG. 3 shows slots 49 located toward the rear of the mid-portion of shim 30, the slots may be located anywhere in the mid-portion, including farther forward, i.e. closer to the toe portion, if desired.

The predominant motion of the shim 30 is transverse to the width of the shoe. Accordingly, the shim 30 may be slightly shorter than or substantially the same length (not shown) as the footbed assembly. The mid-portion of the shim must be narrower than the corresponding mid-portion location of the footbed assembly. The amount of narrowing will depend upon the specific design and the degree of cant adjustment to be provided. Generally, however, the mid-portion of the shim is about 5 to about 35% narrower than the mid-portion of the footbed assembly.

Figure 6:
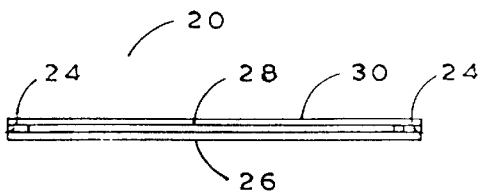
FIG. 6 is a transverse elevational cross-section of the adjustable support system of FIG. 3 taken on line 6—6 thereof.
Figure 5:
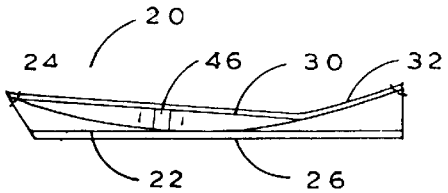
FIG. 5 is a transverse elevational cross-section of the adjustable support system of FIG. 3 taken on line 5—5 thereof.
Figure 4:
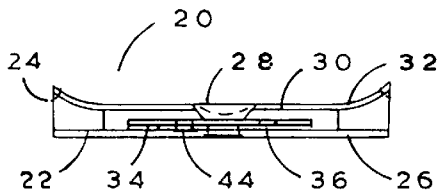
FIG. 4 is a transverse elevational cross-section of the adjustable support system of FIG. 3 taken on line 4—4 thereof.
Figure 7:
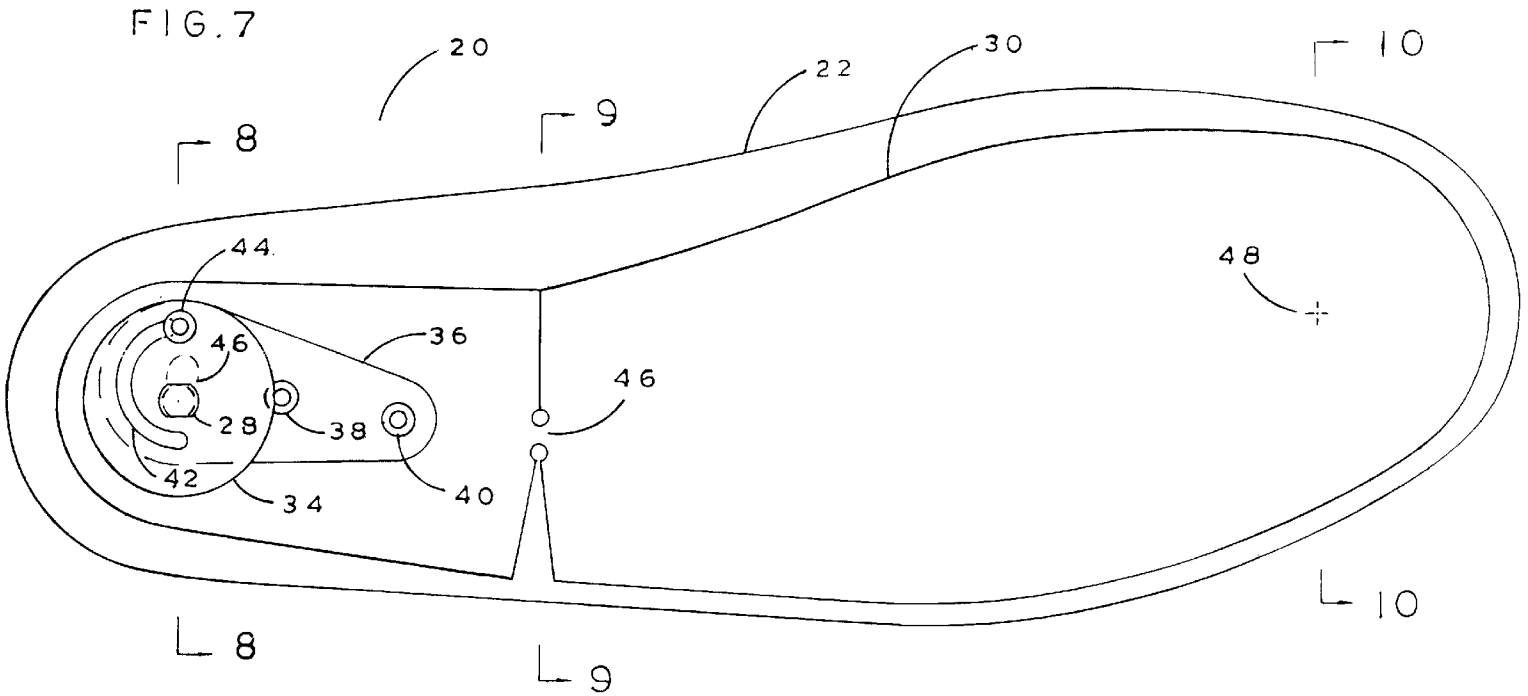
FIG. 7 is another plan view of the adjustable support system of FIG. 2 taken on line 7—7 thereof.
Figure 10:
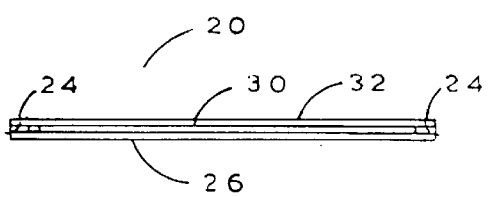
FIG. 10 is a transverse elevational cross-section of the adjustable support system of FIG. 7 taken on line 10—10 thereof.
Figure 9:
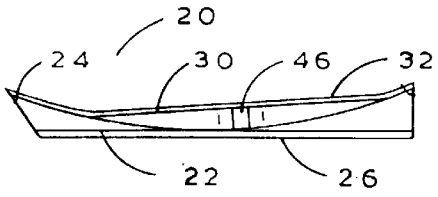
FIG. 9 is a transverse elevational cross-section of the adjustable support system of FIG. 7 taken on line 9—9 thereof.
Figure 8:
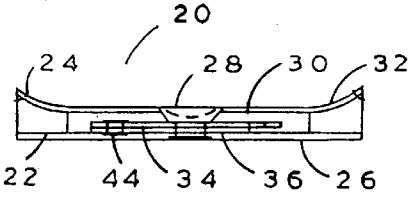
FIG. 8 is a transverse elevational cross-section of the adjustable support system of FIG. 7 taken on line 8—8 thereof.

FIGS. 4–6 show transverse sections of footbed assembly 20 at a maximum adjustment for pronation, having at this adjustment a mid-portional cant of four degrees of so-called "positive" cant angle from the horizontal on the medial side of footbed assembly 20, said cant referring to the transverse angular attitude of the relatively flat top surface of shim 30 covered by socklining 32, when compared to the flat bottom surface of the footbed assembly 20. This canting results from the laterally adjusted movement of the transversely convexly contoured bottom surface of shim 30 in the mid-portion as it is so adjustably repositioned relative to the matching transversely concavely contoured top surface 24 of footbed assembly 20 at the corresponding mid-portion directly thereunder, supporting said shim 30 at its variously adjusted positions.

FIGS. 7–10 similarly show views of the same elements of footbed 20 as they would appear adjusted to the maximum of four degrees of negative cant, as could be required for proper correction of the less frequent condition of excessive supination of the foot.

It should be noted that while the drawings disclose a presently preferred range of canting adjustment of from four degrees positive, infinitely adjustable by the adjustment means described, to the opposite limit of four degrees negative cant, other ranges and areas of maximum and/or minimum canting adjustment are optionally available with appropriate revisions to the design of adjustment means, hinge portions and axes of rotation therein, and are to be considered equivalent to the invention therefor.

Figure 11:
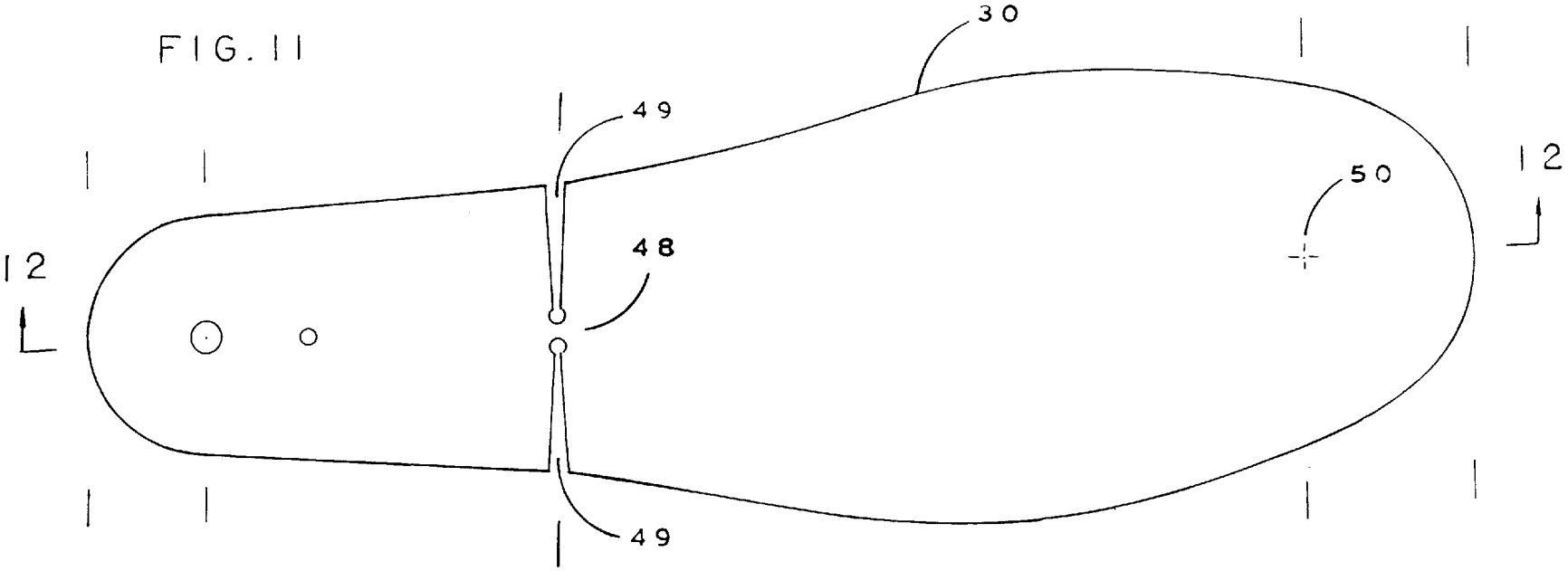
FIG. 11 is a plan view of the adjustably cantable shim element of the adjustable support system of FIG. 2 taken on line 11—11 thereof.
Figure 12:
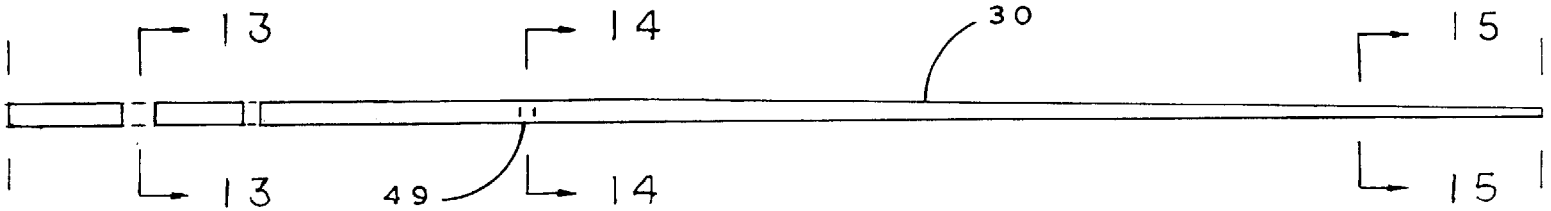
FIG. 12 is a side elevational cross-section of the shim of FIG. 11 taken on line 12—12 thereof.
Figure 13:
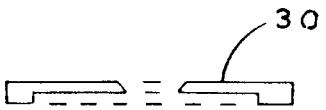
FIG. 13 is a transverse elevational cross-section of the shim of FIG. 12 taken on line 13—13 thereof.
Figure 14:
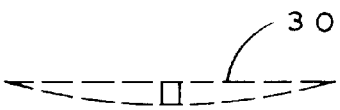
FIG. 14 is a transverse elevational cross-section of the shim of FIG. 12 taken on line 14—14 thereof.
Figure 15:
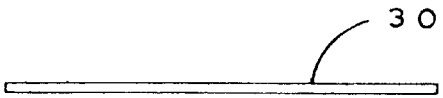
FIG. 15 is a transverse elevational cross-section of the shim of FIG. 12 taken on line 15—15 thereof.
Figure 16:
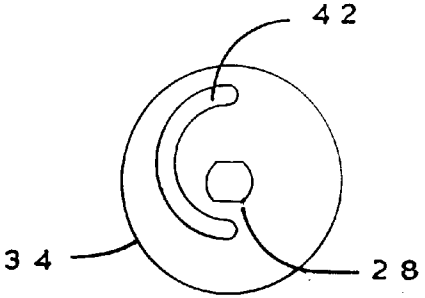
FIG. 16 is a plan view of the circular cam 34 shown in FIGS. 3 and 7.
Figure 17:
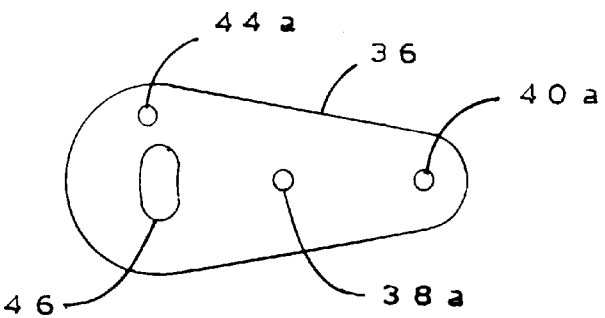
FIG. 17 is a plan view of the strut 36 shown in FIGS. 3 and 7.

FIGS. 11–17 show additional views of the canting adjustment means, with FIGS. 11 and 12 showing respectively the plan view and side elevational cross-section of shim 30 taken on line 12—12 of FIG. 11. FIGS. 13–15 show transverse elevational cross-sections of said shim 30 taken respectively on lines 13—13, 14—14 and 15—15 of FIG. 12. FIG. 16 shows cam 34 with cam-slot 42 and an opening for camshaft 28 therein. FIG. 17 shows strut 36 with slot 46 therein designed to eliminate interference by camshaft 28 during the aforementioned angular adjustment of said strut 36. FIG. 17 also shows openings 38*a*, 40*a*, and 44*a* designed to retain rivets 38, 40, and 44 respectively.

While the elements of footbed assembly 20 may be manufactured from a wide range of suitable materials, those presently preferred include fabric for socklining 32 of Cambrelle® fabric, available from Faytex, Inc., Weymouth, Mass. Footbed base 22 and canting shim 30 are both of polyurethane, custom-molded by Atlantic Thermoplastics, Blackstone, Mass. or others. Bottom element 26 is of fabric-faced Surlyn® extruded sheet material available from Foss, Inc., Hampton, N.H. All metal parts are to be preferably of stainless steel, with cam 34 and strut 36 stamped from 0.015" sheet material, with such stampings supplied by Peter Forg Mfg., Somerville, Mass. and camshaft 28 by Accurounds, Inc., Avon, Mass. and others.

It should be understood that the above disclosures represent only one application of the concepts of this invention and that other designs for use in footbeds and shoe bottom assemblies are considered possible and equivalents under the teachings of this invention.

What is claimed is:

1. An adjustable foot support system for use in a shoe, having a toe portion, a heel portion, and a mid-portion therebetween, comprising (i) a footbed assembly which has a longitudinal center, a flat bottom surface and an upper surface which has raised peripheral edges at the mid-portion that slope gradually downward from each edge toward the longitudinal center of the foot-bed assembly so as to form a concave shaped surface facing upward at about the mid-portion; (ii) a shim member having a toe portion, a heel portion, and a mid-portion therebetween which has a hinge, and having a flat upper surface and a lower surface which has a transversely convex contour at about the mid-portion of the shim facing downward, thereby matching and fitting together with the footbed assembly located therebelow, and having the shim mid-portion being narrower than the corresponding footbed assembly mid-portion location, and (iii) a means for moving the shim member transversely to adjust the angle of the flat upper surface of the shim member relative to the flat bottom surface of the footbed assembly.

2. The adjustable support system of claim 1, wherein the means for moving the shim member comprises a manually adjustable cam member attached to the footbed assembly and the shim member in a manner so as to allow movement of the shim member relative to the footbed assembly.

3. The adjustable support system of claim 1, wherein the hinge is formed by 2 slots extending inward from the peripheral edges of the shim member in the mid-portion thereof.

4. The adjustable support system of claim 1, wherein the system is an integral part of a shoe.

5. The adjustable support system of claim 1, wherein the system is removably insertable from a shoe.

6. The adjustable support system of claim 1, wherein the shim is substantially the same length as the footbed assembly.

7. The adjustable support system of claim 1, wherein the shim is shorter than the footbed assembly.

8. The adjustable support system of claim 1, wherein the mid-portion of the shim is about 5 to about 35% narrower than the corresponding mid-portion location of the footbed assembly.

9. A shoe comprising a shoe upper, a shoe bottom, and an adjustable foot support system in the shoe, said support system comprising a footbed assembly having a longitudinal center, a toe portion, a heel portion, and a mid-portion therebetween, and having a flat bottom surface and an upper surface which has raised peripheral edges at the mid-portion that slope gradually downward from each edge toward the longitudinal center of the footbed assembly so as to form a concave shaped surface facing upward at the mid-portion; (ii) a shim member having a toe portion, a heel portion, and a mid-portion therebetween which has a hinge, and having a flat upper surface and a lower surface which has a transversely convex contour at about the mid-portion of the shim facing downward, thereby matching and fitting together with the footbed assembly located therebelow, and having the shim mid-portion being narrower than the corresponding footbed assembly mid-portion location, and (iii) a means for moving the shim member transversely from side to side, there-by adjusting the angle of the flat upper surface of the shim member relative to the flat bottom surface of the footbed assembly.

10. The shoe of claim 9, wherein the means for moving the shim extends through the bottom of the shoe.

11. The shoe of claim 9, wherein the means for moving the shim is accessible from within the shoe.

12. The shoe of claim 10, wherein the means for moving the shim member comprises a manually adjustable cam member attached to the footbed assembly and the shim member in a manner so as to allow movement of the shim member relative to the footbed assembly.

13. The shoe of claim 9, wherein the hinge is formed by 2 slots extending inward from the peripheral edges of the shim member in the mid-portion thereof.

14. The shoe of claim 9, wherein the shim is substantially the same length as the footbed assembly.

15. The shoe of claim 9, wherein the shim is shorter than the footbed assembly.

16. The shoe of claim 9, wherein the mid-portion of the shim is about 5 to about 35% narrower than the corresponding mid-portion location of the footbed assembly.

* * * * *